US011440626B2

(12) United States Patent
Serena et al.

(10) Patent No.: US 11,440,626 B2
(45) Date of Patent: Sep. 13, 2022

(54) SYSTEM AND METHOD FOR POWER AND DATA TRANSMISSION IN A BODY OF WATER TO UNMANNED UNDERWATER VEHICLES

(71) Applicant: SAIPEM S.p.A., San Donato Milanese (IT)

(72) Inventors: Alberto Serena, Ponzano Veneto (IT); Giovanni Massari, Venice (IT); Diego Lazzarin, Treviso (IT)

(73) Assignee: SAIPEM S.P.A., San Donato Milanese (IT)

( * ) Notice: Subject to any disclaimer, the term of this patent is extended or adjusted under 35 U.S.C. 154(b) by 289 days.

(21) Appl. No.: 16/771,527

(22) PCT Filed: Dec. 7, 2018

(86) PCT No.: PCT/IB2018/059775
§ 371 (c)(1),
(2) Date: Jun. 10, 2020

(87) PCT Pub. No.: WO2019/123080
PCT Pub. Date: Jun. 27, 2019

(65) Prior Publication Data

US 2021/0179233 A1 Jun. 17, 2021

(30) Foreign Application Priority Data

Dec. 18, 2017 (IT) ..... 102017000145949

(51) Int. Cl.
*B63B 22/18* (2006.01)
*B63G 8/00* (2006.01)
*B63B 22/04* (2006.01)

(52) U.S. Cl.
CPC ..... *B63B 22/18* (2013.01); *B63B 22/04* (2013.01); *B63G 8/001* (2013.01);
(Continued)

(58) Field of Classification Search
CPC ..... B63B 22/18; B63B 22/04; B63B 2203/00; B63B 2205/04; B63B 2205/06;
(Continued)

(56) References Cited

U.S. PATENT DOCUMENTS 4,685,742 A 8/1987 Moreau
6,390,012 B1 * 5/2002 Watt ..... B63B 27/36 114/51

(Continued)

FOREIGN PATENT DOCUMENTS

EP 0 483 996 A2 5/1992
EP 1 218 239 B1 5/2008

(Continued)

OTHER PUBLICATIONS

Notification Concerning Submission, Obtention or Transmittal of Priority Document for International Application No. PCT/IB2018/059775 dated Feb. 27, 2019.

(Continued)

*Primary Examiner* — Daniel V Venne
(74) *Attorney, Agent, or Firm* — Neal, Gerber & Eisenberg LLP

(57) ABSTRACT

A system for power and data transmission in a body of water to unmanned underwater vehicles comprises a floating surface station for generating electric energy and receiving and transmitting data; an underwater station connectable to at least one unmanned underwater vehicle; at least one submerged depth buoy; and an umbilical, which comprises a power transmission line and a data transmission line, is mechanically and electrically connected to the surface station and to the underwater station, and is mechanically coupled to the depth buoy so that the umbilical comprises a first umbilical section that is stretched between the underwater station and the depth buoy and a second umbilical (Continued)

section that extends loose between the depth buoy and the surface station.

20 Claims, 5 Drawing Sheets

(52) U.S. Cl.
CPC ..... *B63B 2203/00* (2013.01); *B63B 2205/04* (2013.01); *B63B 2205/06* (2013.01); *B63B 2209/00* (2013.01); *B63G 2008/007* (2013.01)

(58) Field of Classification Search
CPC ..... B63B 2209/00; B63G 8/001; B63G 2008/007; B63G 2008/002
USPC ..... 114/256, 258, 312, 313; 441/1, 4; 340/539.13
See application file for complete search history.

(56) References Cited

U.S. PATENT DOCUMENTS

| | | | | |
|---|---|---|---|---|
| 9,505,473 | B2 | 11/2016 | Kerins et al. | |
| 2009/0114140 | A1* | 5/2009 | Guerrero | B63C 11/52 114/321 |
| 2011/0198092 | A1* | 8/2011 | Machin | E21B 33/076 166/349 |

FOREIGN PATENT DOCUMENTS

| | | | |
|---|---|---|---|
| EP | 2 474 467 | A1 | 7/2012 |
| EP | 2 824 822 | A1 | 1/2015 |
| EP | 3 253 895 | | 12/2017 |
| EP | 3 253 945 | | 12/2017 |
| JP | 2003 048594 | A | 2/2003 |
| WO | WO 2010/019675 | A2 | 2/2010 |
| WO | WO 2015/124938 | A1 | 8/2015 |
| WO | WO 2017/019558 | A1 | 2/2017 |
| WO | WO 2017/153966 | A1 | 9/2017 |

OTHER PUBLICATIONS

International Search Report and Written Opinion for International Application No. PCT/IB2018/059775 dated Feb. 21, 2019.
PCT Demand for International Preliminary Examination and Reply to International Search Report and the associated Written Opinion for International Application No. PCT/IB2018/059775 dated Sep. 23, 2019.
Notification of Receipt of Demand by Competent International Preliminary Examining Authority (Form PCT/IPEA/402) for International Application No. PCT/IB2018/059775 dated Sep. 27, 2019.
Second Written Opinion for International Application No. PCT/IB2018/059775 dated Nov. 7, 2019.
Reply to the Second Written Opinion for International Application No. PCT/IB2018/059775 dated Jan. 7, 2020.
Notification of Transmittal of the International Preliminary Report on Patentability (Form PCT/IPEA/416) for International Application No. PCT/IB2018/059775 dated Feb. 28, 2020.

* cited by examiner

SYSTEM AND METHOD FOR POWER AND DATA TRANSMISSION IN A BODY OF WATER TO UNMANNED UNDERWATER VEHICLES

PRIORITY CLAIM

This application is a national stage application of PCT/IB2018/059775, filed on Dec. 7, 2018, which claims the benefit of and priority to Italian Patent Application No. 102017000145949, filed on Dec. 18, 2017, the entire contents of which are each incorporated by reference herein.

TECHNICAL FIELD

The present disclosure relates to a system for power and data transmission in a body of water to unmanned underwater vehicles. In particular, the present disclosure finds advantageous application in deep waters.

BACKGROUND

In the oil & gas sector, the use of unmanned underwater vehicles to perform inspection, monitoring, maintenance and repair of underwater installations generally located on the bed of the body of water is very widespread. There are substantially two types of unmanned underwater vehicles: underwater vehicles of the first type are the so-called Remotely Operated Vehicles (ROVs) and are characterized in that they are connected to a cable designed for power and data transmission; underwater vehicles of the second type are the so-called Autonomous Unmanned Vehicles (AUVs) and are characterized in that they are powered by batteries, which are recharged on board a vessel.

The development of permanent underwater installations for hydrocarbon extraction and/or treatment requires unmanned underwater vehicles with a greater degree of endurance than current standards. The definition "permanent underwater installation" refers to an installation designed to operate in a body of water, generally on the bed of a body of water, for a number of years and is described in patent applications EP 3,253,895 and EP 3,253,945 belonging to the applicant. An underwater station for housing, powering, and maintaining unmanned underwater vehicles has been described in patent application WO 2017/153,966 also belonging to the applicant. The underwater station needs to be supplied with power, typically electric energy, and to exchange data with a surface station.

Generally, power and data transmission between the underwater station and the surface station is achieved through an umbilical connected to the underwater station and the surface station. U.S. Pat. No. 9,505,473, PCT Patent Application No. WO 2015/124,938, PCT Patent Application No. WO 2017/019,558 and EP Patent No. 2,824,822 show different configurations of power and/or data transmission systems between a surface station and an underwater station via umbilicals.

Furthermore, EP Patent No. 2,474,467 discloses a marine device comprising a submerged payload adapted to record seismic and/or electromagnetic data and transfer said data to a processing unit which can be located on a ship.

EP Patent No. 1,218,239 discloses a remotely operable underwater apparatus for interfacing with, transferring power to, and sharing data with other underwater devices, comprising a flying latch vehicle in order to bridge power and data between two devices.

JP Patent No. 2003/048594 discloses a smart buoy that executes position control and position holding on its own decision.

Problems associated with certain existing systems are that the umbilical and the surface station are subject to weather and sea conditions, therefore the umbilical is subject to many stresses which can compromise the integrity and functionality thereof over time.

SUMMARY

The object of the present disclosure is to provide a system for power and data transmission in a body of water to unmanned underwater vehicles, which mitigates certain of the drawbacks of certain the prior art.

In accordance with the present disclosure, a system for power and data transmission in a body of water to unmanned underwater vehicles is provided, the system comprising:

- a floating surface station configured to generate electric energy and receiving and transmitting data;
- an underwater station connectable to at least one unmanned underwater vehicle;
- at least one depth buoy;
- an umbilical, which comprises at least one power transmission line and at least one data transmission line, is mechanically and electrically connected to the surface station and to the underwater station, and is mechanically coupled to the depth buoy so that the umbilical comprises a first umbilical section that is stretched between the underwater station and the depth buoy and a second umbilical section that extends loose between the depth buoy and the surface station; and
- a winch for selectively adjusting the length of the first umbilical section and the depth of the depth buoy.

The system according to the present disclosure minimizes the fatigue stresses on the umbilical caused by weather and sea conditions, which are typically variable within a depth range near the surface of the body of water. In this manner, the deployed length of the umbilical, and in particular the depth of the depth buoy, can even be adjusted in situ during the installation of the umbilical.

The umbilical length adjustment has the purpose of adapting the length of the umbilical when the usage requirements, in this case the depth of the body of water, change. The initial adjustment can be performed before or after the underwater installation, on the basis of simulations. In general, the presence of the winch enables relative considerable flexibility of use and reuse of the umbilical.

In accordance with one embodiment of the present disclosure, the system comprises an unmanned underwater vehicle and a cable connected to the underwater station and to the unmanned underwater vehicle, the cable being configured for power and data transmission to and from the underwater station. In this manner, power and data transmission can be directly provided between the station and the underwater vehicle.

Alternatively, the unmanned underwater vehicle is not connected to the underwater station via a cable, and power and data transmission between the surface station and the unmanned underwater vehicle takes place when the unmanned underwater vehicle is arranged in a charging station located in the base station.

The connection may be a mechanical and/or electromagnetic induction and/or electromagnetic resonance connection.

In particular, the surface station comprises a dynamic positioning device controlled so as to keep the second umbilical section relatively loose in any operational phase.

The dynamic positioning device comprises a satellite DGPS system (corrected satellite GPS) for position detection; low-power and adjustable screw propellers; and a control unit for controlling the propellers and possibly correcting the position thereof. As an alternative to the satellite system, the dynamic positioning device can be configured to control the position of the surface station with respect to a related reference system such as for example the depth buoy. In this way, the surface station is maintained in a substantially stationary position via the dynamic positioning device. Since the depth buoy assumes a substantially steady position in the body of water, it is possible to select a position and orientation of the surface station, which keeps the second umbilical section relatively loose and avoids twisting of the umbilical. It should be appreciated that since slight vertical and lateral displacements of the surface station and the depth buoy are however possible, the relatively loose configuration of the second umbilical section enables relative movements between the surface station and the depth buoy without generating relative dangerous stresses for the integrity and functionality of the umbilical.

In particular, the system comprises a control station configured for controlling the relative position between the surface station and the depth buoy, and the dynamic positioning device.

In particular, the control station is connected to the surface station by radio. In this manner, the control station can be installed in a location remote from the surface station, for example on a vessel or on land. For this purpose, the surface station comprises an antenna for receiving and transmitting data.

In particular, the surface station comprises a power generation unit selected from: an endothermic engine coupled to an electric generator; a closed loop endothermic engine coupled to an electric generator; fuel cells; a wind turbine; solar cells; and a wave turbine. In this way, power generation occurs in a location that is relatively easily accessible for recharging and maintenance and relatively close to the users located in the body of water.

In particular, the system comprises a mechanical connector mounted at the bottom end of the umbilical for mechanically connecting the umbilical to the underwater station.

It should be appreciated that during the system installation phase configurations are defined that will enable relatively easy mechanical connection to the base station. The aspect of the ease of connection is all the more relevant, the greater the depth of the bed of the body of water on which the underwater station is resting.

In particular, the system comprises a ballast coupled to the bottom end of the umbilical in order to facilitate the vertical descent of the umbilical during the installation of the system.

In particular, the depth buoy extends about the umbilical and is connected to the umbilical.

In practice, the depth buoy has a substantially cylindrical shape and an axial opening, which houses therein a short section of the umbilical. In this way, the depth buoy does not force the umbilical to form curves in the vicinity of the depth buoy.

Alternatively, the depth buoy has a connection point arranged on the bottom side of the depth buoy. In this way, the buoy is relatively simple. In certain embodiments, the depth buoy includes stiffening elements in the vicinity of the connection point in order to stiffen the umbilical so as to avoid folds potentially dangerous for the integrity of the umbilical.

In accordance with a further alternative, the depth buoy comprises a plurality of sleeves fitted to an intermediate umbilical section. In this way, the vertical thrust provided by the buoy is distributed along an intermediate umbilical section, which can assume a relatively large-radius, curved configuration.

A further object of the present disclosure is to provide a method for power and data transmission in a body of water to unmanned underwater vehicles, which mitigates certain of the drawbacks of certain of the prior art.

In accordance with the present disclosure, a method for power and data transmission in a body of water to unmanned underwater vehicles is provided, the method comprising the steps of:

- generating electric energy in a floating surface station;
- transferring power between the surface station and an underwater station by an umbilical;
- exchanging data between the surface station and the underwater station by said umbilical;
- stretching a first umbilical section by a depth buoy, the first umbilical section extending between the underwater station and the depth buoy;
- keeping a second umbilical section, extending between the depth buoy and the surface station, relatively loose; and
- selectively adjusting the length of the first umbilical section and the depth of the depth buoy by a winch.

In this way, the umbilical is prevented from being subjected to relative dangerous fatigue stresses and is relatively simple to install.

In particular, the method according to the present disclosure comprises controlling the position of the surface station by a dynamic positioning device for keeping the second umbilical section relatively loose in any operational phase.

The dynamic positioning device enables the surface station to be arranged in a substantially geostationary position. It should be appreciated that relative small displacements of the surface station are possible and these displacements are compensated for by the second umbilical section in the relatively loose configuration.

In particular, the method comprises controlling the relative position between the surface station and the depth buoy, and actuating the dynamic positioning device as a function of the relative position.

In general, the dynamic positioning also serves to avoid tensile and torsional stress on the umbilical.

In particular, the method comprises selecting the length of the first umbilical section so that the depth buoy is located at a depth within the range between 40 meters and 70 meters.

It should be appreciated that the positioning of the depth buoy arranged at a depth where the weather and sea conditions are substantially constant.

In particular, the method comprises selecting the length of the second umbilical section so that said second umbilical section is much greater than the depth of the depth buoy. This enables relatively large displacements between the surface station and the depth buoy.

BRIEF DESCRIPTION OF THE FIGURES

Further features and advantages of the present disclosure will be apparent from the following description of non-limiting embodiments thereof, with reference to the figures of the accompanying drawings, wherein.

DETAILED DESCRIPTION

Figure 1:
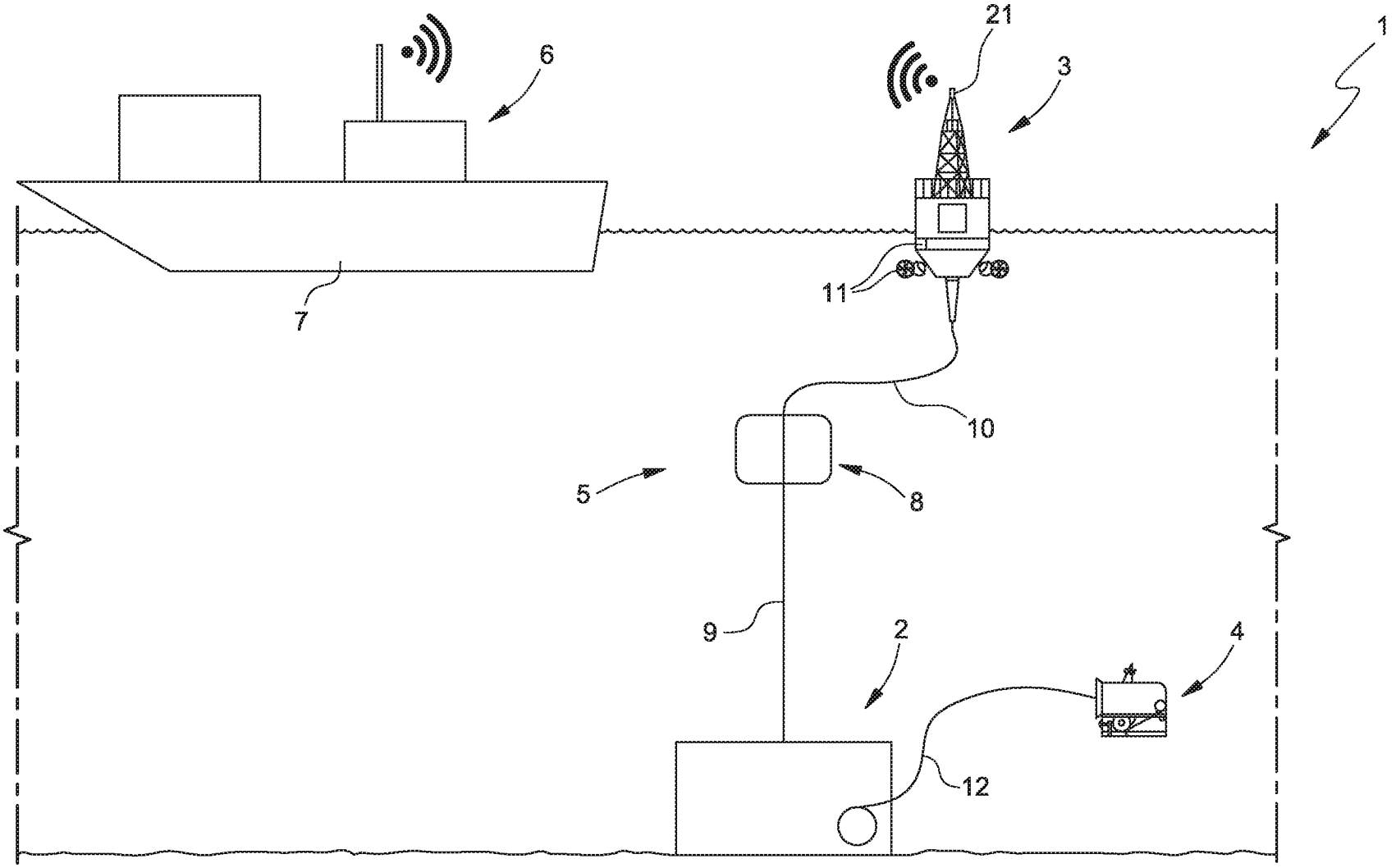
FIG. 1 is a schematic view, with parts removed for clarity, of a system for power distribution and data transmission in a body of water for powering unmanned underwater vehicles in accordance with the present disclosure.

With reference to FIG. 1, a system 1 for power distribution and data transmission in a body of water is depicted as a whole. The system 1 comprises an underwater station 2; a surface station 3; at least one unmanned underwater vehicle 4; and an umbilical 5 mechanically and functionally connected to the underwater station 2 and the surface station 3. The system 1 is controlled by a control station 6, which, in FIG. 1, is arranged on board a support vessel 7.

In one variant (not shown), the control station is located on land.

The system 1 comprises a depth buoy 8, which is fixed to the umbilical 5 and arranged in the body of water between the underwater station 2 and the surface station 3 so that the umbilical 5 has a section 9, which extends between the underwater station 2 and the depth buoy 8, and a section 10, which extends between the depth buoy 8 and the surface station 3.

The underwater station 2 is installed on the bed of the body of water, whereas the surface station 3 is a floating station controlled by a dynamic positioning device 11, which enables the surface station 3 to be kept in a substantially stationary position and with a given or designated orientation. The dynamic positioning device 11 may comprise a satellite position detection system so as to maintain the surface station in a geostationary position, or may comprise a detection system configured to maintain the position of the surface station stationary with respect to other reference systems such as for example the depth buoy 8. The dynamic positioning device 11, in addition to the detection system, comprises adjustable screw propellers; and a control unit configured to control the power and orientation of the propellers according to the signals detected by the detection system.

The system 1 is configured to keep the first umbilical section 9 stretched at a controlled tension and the second umbilical section 10 relatively loose so as to follow the relative movements between the surface station 3 and the depth buoy 8 and avoid fatigue stresses on the umbilical 5 caused by weather and sea conditions.

In the illustrated case, the unmanned underwater vehicle 4 is a ROV connected to the underwater station 2 via a cable 12.

Figure 2:
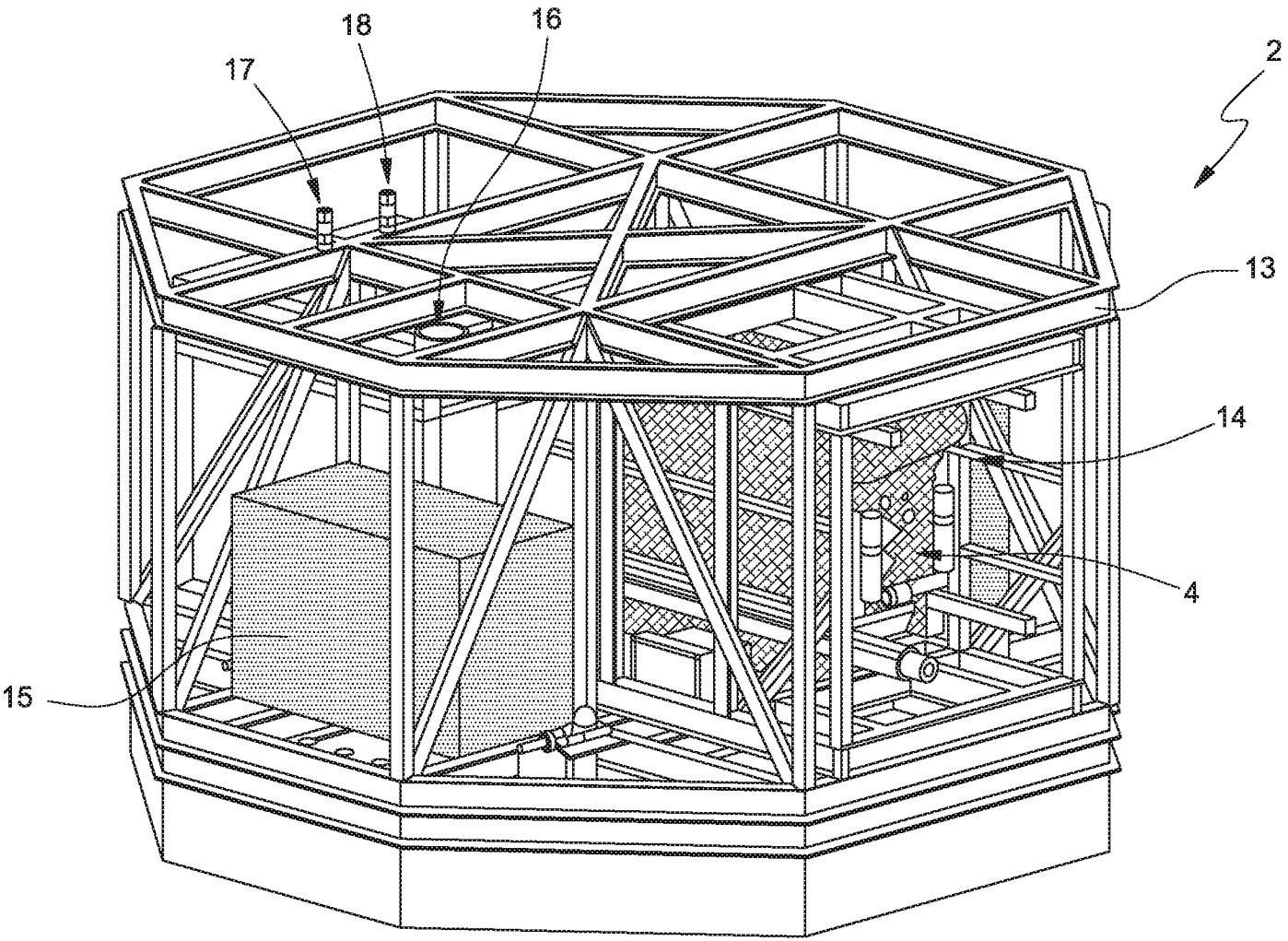
FIG. 2 is a perspective view, with parts removed for clarity, of an underwater station of the system according to the present disclosure.

With reference to FIG. 2, the underwater station 2 has a support structure 13 configured to be laid on the bed of the body of water and to accommodate the unmanned underwater vehicle 4 in a specially provided charging station 14. The underwater station 2 comprises auxiliary, mechanical and electrical equipment 15; a coupling device 16 configured to mechanically connect the umbilical 5 to the underwater station 2, and electrical connection devices 17 and 18 to provide the power and data connection between the umbilical 5 and the underwater station 2.

Figure 3:
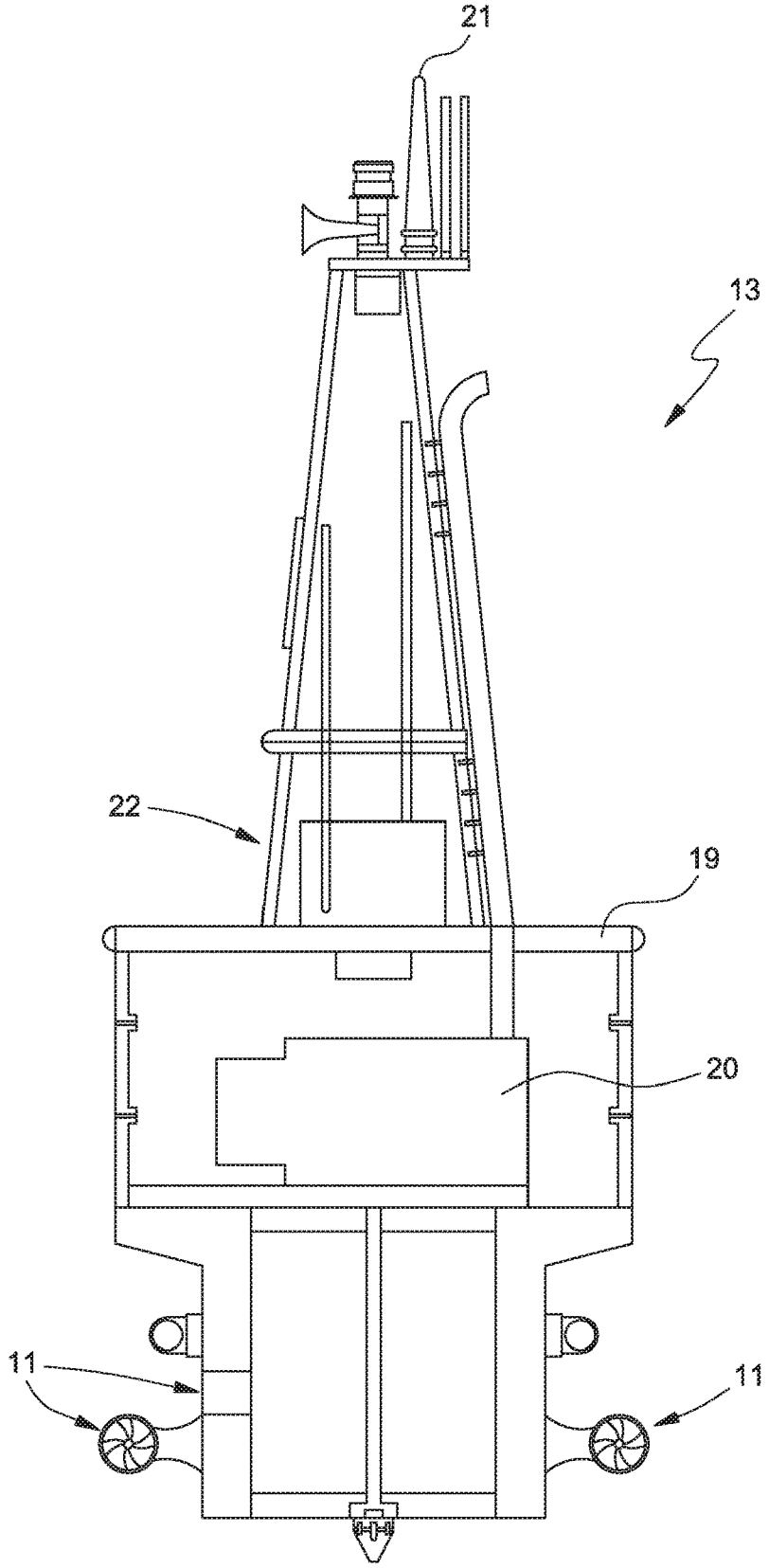
FIG. 3 is a schematic, side elevation view, with parts removed for clarity, of a surface station of the system according to the present disclosure.

With reference to FIG. 3, the surface station 3 comprises a support structure 19 and accommodates a power generation unit 20 configured to produce electric energy; an antenna 21 configured to receive and transmit data; and service equipment 22. In the illustrated case, the power generation unit 20 comprises an electrical generator driven by an endothermic engine and is housed in a semi-submerged hold of the surface station 3.

In accordance with alternative embodiments (not shown), the generator unit comprises fuel cells or a wind turbine or solar cells or a wave turbine.

With reference to FIG. 1, the umbilical 5 is configured to supply power and transmit data and is stably connected to the underwater station 2 and the surface station 3 so as to transmit the power generated in the surface station 3 to the connected users in the underwater station 2 and transmit data between the underwater station 2 and the surface station 3. For this purpose, the umbilical 5 comprises therein power lines and data lines (not shown in the attached Figures).

The depth buoy 8 extends about the umbilical 5 and is fastened to the umbilical 5.

Figure 4:
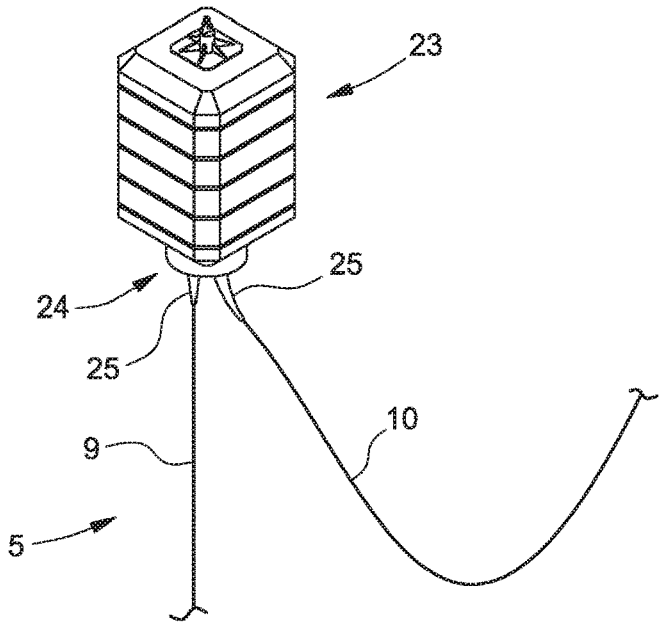
FIGS. 4 and 5 are perspective views, with parts removed for clarity, of respective variants of a detail of the system in FIG. 1.

FIG. 4 shows a depth buoy 23, which is a variant of the buoy 8 and is fastened to the umbilical 5. The buoy 23 has a connection point 24 for connection to the umbilical 5, at which point the umbilical 5 defines a curve. The umbilical sections 9 and 10 at the depth buoy 23 are associated with stiffening elements 25 in order to prevent the formation of folds in the umbilical 5.

Figure 5:
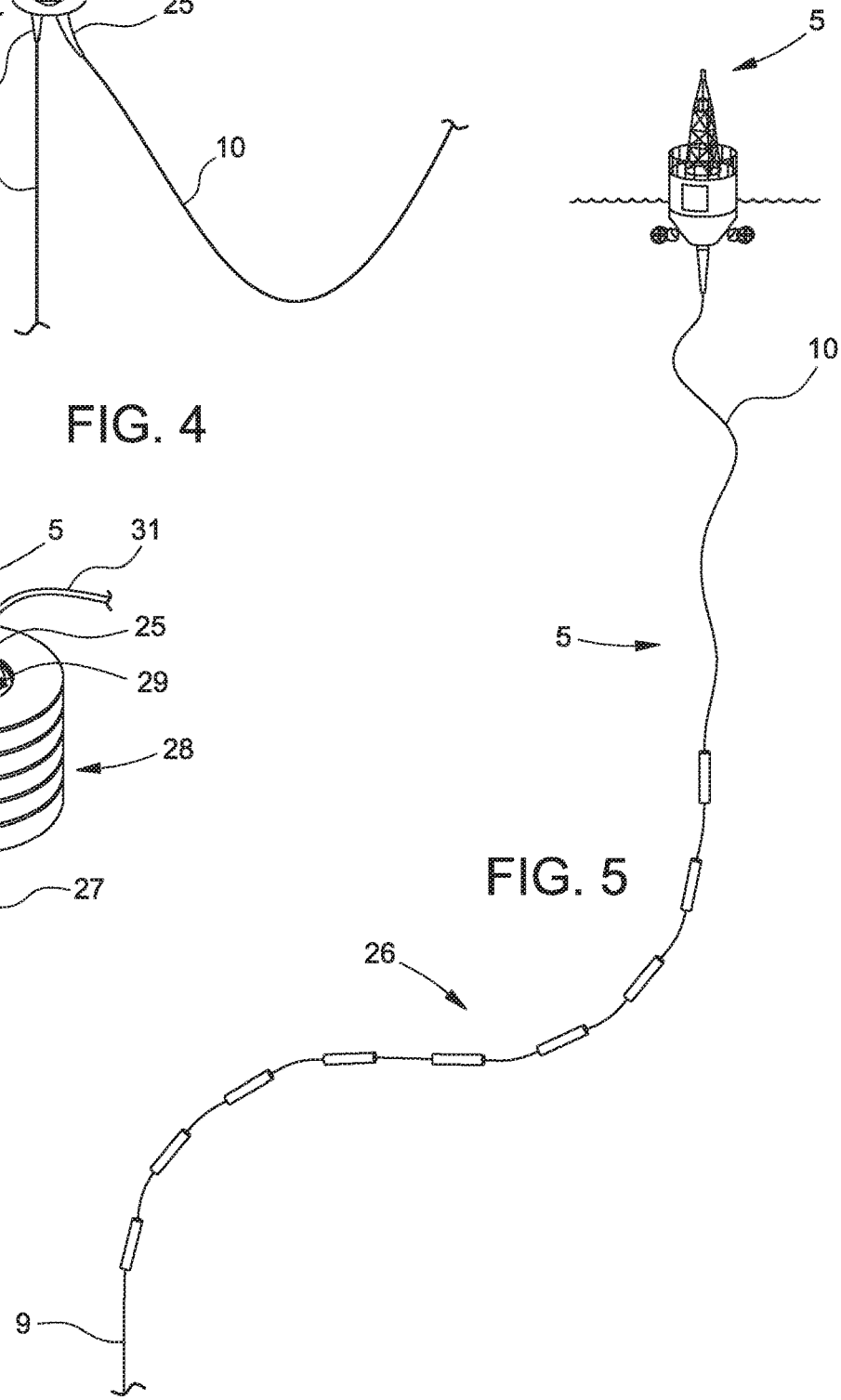

FIG. 5 shows a depth buoy 26, which represents an alternative to the intermediate buoys 8 (FIG. 1) and 23 (FIG. 4). The depth buoy 26 comprises a plurality of sleeves fitted and secured around the umbilical 5. The buoy 26 extends along an intermediate umbilical section 5 of considerable length interposed between the sections 9 and 10. The buoy 26 transmits a distributed load to the umbilical 5 and the intermediate section can assume a curved configuration.

Figure 6:
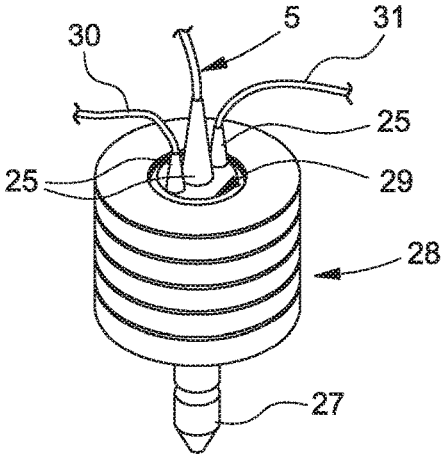
FIG. 6 is a perspective view, with parts removed for clarity, of a detail of the system in FIG. 1.

With reference to FIG. 6, the bottom end of the umbilical 5 comprises a mechanical connector 27 configured to secure the umbilical 5 to the underwater station 2 (FIG. 1). The bottom end of the umbilical 5 is associated with a ballast 28, which in certain embodiments has a cylindrical shape and houses therein a junction box 29. The umbilical 5 is connected to the junction box from which a power terminal 30 and a data terminal 31 (in certain embodiments defined by a fiber-optic cable,) protrude. The umbilical 5 and the terminals 30 and 31 are protected by stiffening elements 25 at the junction box 29.

In use and with reference to FIG. 1, the surface station 3 generates electrical energy through the power generation unit 20 and exchanges signals with the control station 6 via the antenna 21. The surface station 3 is mechanically and functionally connected to the umbilical 5, which transmits energy and exchanges data with the underwater station 2, which in tum is connected to the unmanned underwater vehicle 4 in order to supply energy and exchange data.

The umbilical section 9 is kept stretched by the depth buoy 8. The length of the umbilical section 9 is selected so that the depth buoy 8 is located at a depth within the range between 70 and 30 meters lower than the surface of the body of water. The length of the umbilical section 10 is selected so that the umbilical section is considerably greater than the depth of the buoy 8, to enable relative misalignments between the depth buoy 8 and the surface station 3 with respect to a vertical direction, and distance variations between the depth buoy 8 and the surface station 3. In other words, the weather and sea conditions, such as wave motion, currents and tides, can cause relative displacements between the surface station 3 and the depth buoy 8. These weather and sea phenomena are typically variable near the surface of the body of water.

The dynamic positioning device 11 of the surface station 3 in any case maintains the surface station 3 in the vicinity of the depth buoy 8 so as to keep the umbilical section 10 relatively loose and enable relative displacements between the depth buoy 8 and the surface station 3 without subjecting the umbilical section 10 to tensile and torsional stress.

The operation of the system 1 does not change as a function of the type of depth buoy used. In other words, the system 1 may be equipped with a depth buoy 8 or a depth buoy 23 or a depth buoy 26, without changing the mode of operation.

Figure 7:
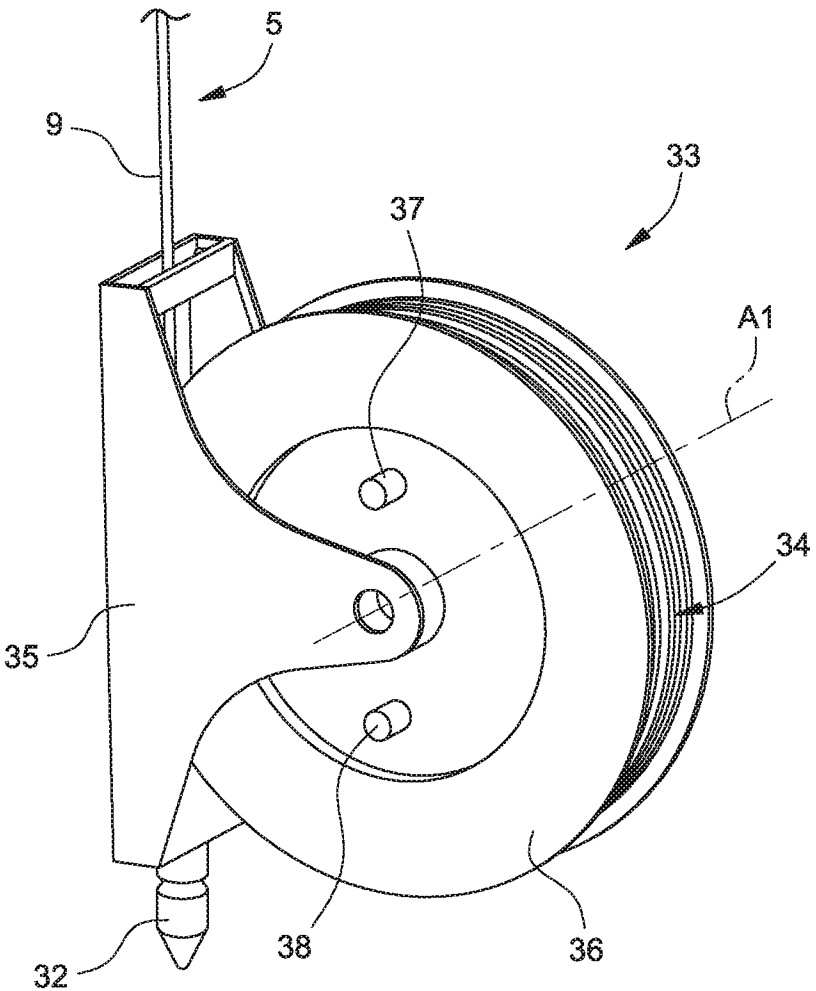

With reference to the variant in FIG. 7, the bottom part of the umbilical 5 comprises a mechanical connector 32 configured to secure the umbilical 5 to the underwater station 2 (FIG. 1). In the illustrated case, the mechanical connector 32 is associated with a winch 33 around which an end umbilical section 34 is wound. The winch 33 has a frame 35 and a spool 36 supported by the frame 35 so that it can selectively rotate about an axis Al and, if sufficiently heavy, may also serve as a ballast. The winch 33 houses therein a junction box (not shown in the attached Figures) from which a power terminal and a data terminal (also not shown in the attached Figures) protrude, which are connected to two connectors 37 and 38, respectively, arranged along the spool 36.

In use of certain embodiments, the winch 33 is housed within the underwater station 2 (FIG. 1) and in such a way that the useful length of the umbilical 5 can be adjusted, and the length of the umbilical section 9 and the depth of the depth buoy 8 can be determined (FIG. 1).

Figure 8:
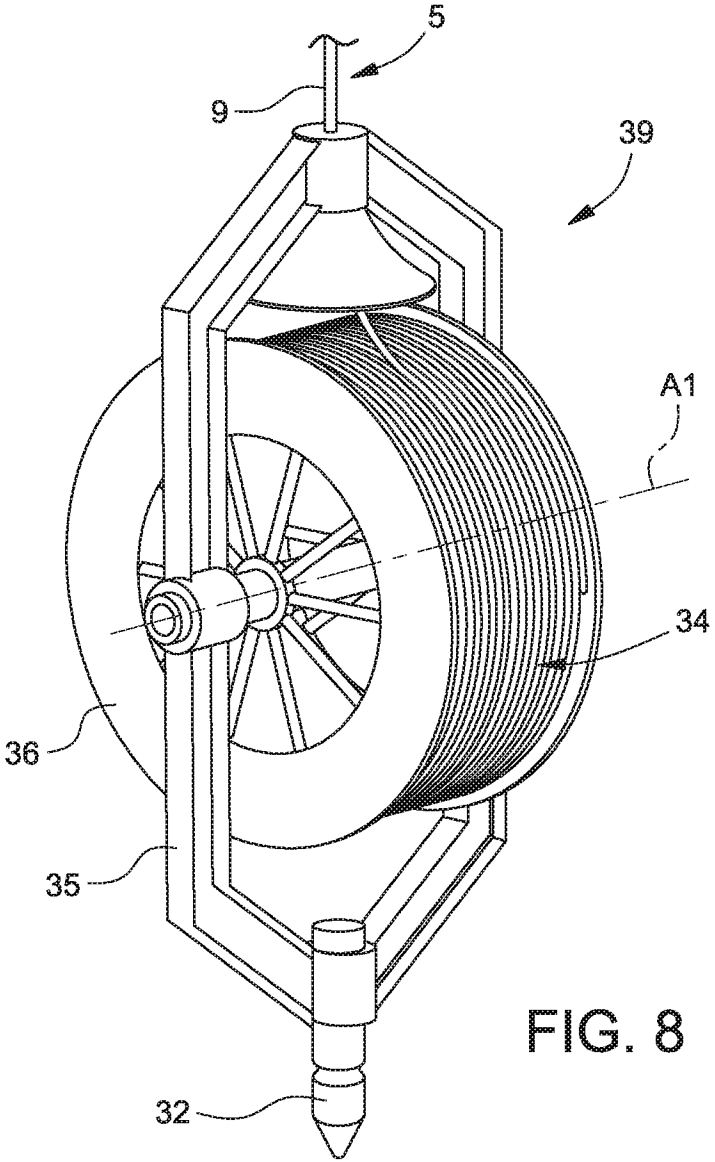
FIGS. 7 and 8 are perspective views, with parts removed for clarity, of respective variants of the detail in FIG. 6.

The winch 39 shown in FIG. 8 is a variant of the winch 33 shown in FIG. 7 and differs from the latter in that the center of gravity of the winch 39 is aligned with the axis of the deployed umbilical.

It is clear that the present disclosure includes further variants that are not explicitly described, without however departing from the scope of protection of the following claims. Accordingly, various changes and modifications to the presently disclosed embodiments will be apparent to those skilled in the art.

The invention claimed is:

1. A power and data transmission system comprising:

a floating surface station configured to:

generate electric energy, receive data, and transmit data;

an underwater station;

a depth buoy;

an umbilical comprising a power transmission line and a data transmission line, the umbilical being mechanically and electrically connected to the floating surface station and to the underwater station, the umbilical being mechanically coupled to the depth buoy such that the umbilical comprises a first umbilical section that extends in a stretched configuration between the underwater station and the depth buoy and a second umbilical section that extends in a loose configuration between the depth buoy and the floating surface station; and a winch configured to selectively adjust a length of the first umbilical section and a depth of the depth buoy.

2. The power and data transmission system of claim 1, further comprising an unmanned underwater vehicle and a cable connected to the underwater station and to the unmanned underwater vehicle, the cable being configured for power transmission and data transmission to and from the underwater station.

3. The power and data transmission system of claim 1, wherein the floating surface station comprises a dynamic positioning device controlled to keep the second umbilical section in the loose configuration in different operational phases.

4. The power and data transmission system of claim 3, further comprising a control station configured to control, via the dynamic positioning device, a relative position between the floating surface station and the depth buoy.

5. The power and data transmission system of claim 4, wherein the control station is connected to the floating surface station by radio.

6. The power and data transmission system of claim 1, wherein the floating surface station comprises an antenna configured to transmit and receive data.

7. The power and data transmission system of claim 1, wherein the floating surface station comprises a power generation unit selected from any of: an endothermic engine coupled to an electric generator, a closed loop endothermic engine coupled to the electric generator, a fuel cell, a wind turbine, a solar cell, and a wave turbine.

8. The power and data transmission system of claim 1, further comprising a mechanical connector mounted at a bottom end of the umbilical and configured to mechanically connect the umbilical to the underwater station.

9. The power and data transmission system of claim 8, further comprising a ballast coupled to the bottom end of the umbilical.

10. The power and data transmission system of claim 1, wherein the depth buoy extends about the umbilical and is connected to the umbilical.

11. The power and data transmission system of claim 1, wherein the depth buoy comprises a connection point on a bottom side of the depth buoy.

12. The power and data transmission system of claim 1, wherein the depth buoy comprises a plurality of sleeves fitted to an intermediate umbilical section.

13. The power and data transmission system of claim 1, wherein the stretched configuration comprises the first umbilical section being maintained at a first tension and the loose configuration comprises the second umbilical section being maintained at a second, lesser tension.

14. A system comprising:

a depth buoy; and an umbilical comprising a power transmission line and a data transmission line, the umbilical being mechanically and electrically connectable to a floating surface station configured to generate electric energy, receive data, and transmit data, the umbilical being mechanically and electrically connectable to an underwater station connectable to an unmanned underwater vehicle, the umbilical being mechanically coupleable to the depth buoy such that the umbilical comprises a first umbilical section that extends in a stretched configuration between the underwater station and the depth buoy and a second umbilical section that extends in a loose configuration between the depth buoy and the floating surface station; and a winch configured to selectively adjust a length of the first umbilical section and a depth of the depth buoy.

15. A method for power and data transmission in a body of water to an unmanned underwater vehicle, the method comprising:

generating electric energy in a floating surface station;

transferring power, via an umbilical, between the floating surface station and an underwater station;

exchanging data, via the umbilical, between the floating surface station and the underwater station;

stretching, via a depth buoy, a first section of the umbilical which extends between the underwater station and the depth buoy;

keeping loose a second section of the umbilical section which extends between the depth buoy and the floating surface station; and selectively adjusting, via a winch, a length of the first section of the umbilical section and a depth of the depth buoy.

16. The method of claim 15, further comprising transferring power and data between the underwater station and the unmanned underwater vehicle.

17. The method of claim 15, further comprising controlling a position of the floating surface station by a dynamic positioning device to keep the second section of the umbilical loose in any operational phase.

18. The method of claim 17, further comprising:

controlling the relative position between the floating surface station and the depth buoy, and actuating the dynamic positioning device as a function of said relative position.

19. The method of claim 15, further comprising selecting the length of the first section of the umbilical such that the depth buoy is located at a depth within the range between 40 meters and 70 meters.

20. The method of claim 15, further comprising selecting the length of the second section of the umbilical section such that the second section of the umbilical greater than the depth of the depth buoy.

* * * * *